US006220389B1

(12) United States Patent
Krause

(10) Patent No.: US 6,220,389 B1
(45) Date of Patent: Apr. 24, 2001

(54) FOLDING LADDER

(75) Inventor: Guenther Krause, Alsfeld (DE)

(73) Assignee: Krause-Werk GmbH & Co. KG, Alsfeld-Altenburg (DE)

( * ) Notice: Subject to any disclaimer, the term of this patent is extended or adjusted under 35 U.S.C. 154(b) by 0 days.

(21) Appl. No.: 09/355,677

(22) PCT Filed: Feb. 14, 1998

(86) PCT No.: PCT/EP98/00844

§ 371 Date: Aug. 2, 1999

§ 102(e) Date: Aug. 2, 1999

(87) PCT Pub. No.: WO98/39546

PCT Pub. Date: Sep. 11, 1998

(30) Foreign Application Priority Data

Mar. 4, 1997 (DE) ..... 297 03 876 U

(51) Int. Cl.[7] ..... E06C 1/00; E06C 7/00
(52) U.S. Cl. ..... 182/23; 182/163; 182/228.6
(58) Field of Search ..... 182/23, 163, 166, 182/167, 195, 228.1, 228.6

(56) References Cited

U.S. PATENT DOCUMENTS 3,858,684 * 1/1975 Goings ..... 182/228.6 X
4,182,431 * 1/1980 Wing ..... 182/23
4,371,055 * 2/1983 Ashton et al. ..... 182/23 X
4,376,470 * 3/1983 Ashton ..... 182/23
4,377,020 * 3/1983 Vigo ..... 16/329
4,606,432 * 8/1986 Belt ..... 182/204
4,854,420 * 8/1989 Juang ..... 182/166
4,951,780 * 8/1990 Kim ..... 182/167 X
4,989,692 * 2/1991 Min ..... 182/166
5,062,499 11/1991 Tu .
5,074,377 * 12/1991 Krause ..... 182/167

FOREIGN PATENT DOCUMENTS 44 03 001 8/1994 (DE) .

* cited by examiner

*Primary Examiner*—Daniel P. Stodola
*Assistant Examiner*—Hugh B. Thompson
(74) *Attorney, Agent, or Firm*—Flynn, Theil, Boutell & Tanis, P.C.

(57) ABSTRACT

The pull-out sections of folding ladders must be locked on the guiding elements pertaining thereto for ladder use and should also be easily unlocked. A locking bolt used to fix the elements can be axially and manually moved inside a guide element against an adjustment spring to engage a hollow profile section of a rung on the pull-out sections. A lockable guide element with a bayonet fitting is included on the ladder element to enable easy locking and unlocking.

14 Claims, 4 Drawing Sheets

FOLDING LADDER

FIELD OF THE INVENTION

The invention relates to a folding ladder, the ladder elements of which can be telescopically extended by means of pull-out sections movable thereon, whereby the pull-out sections can be fixed by means of a locking mechanism in several positions on the respectively associated ladder element on one of its rungs—constructed as a hollow-profile section—which locking mechanism has a locking bolt, which can be guided into the hollow-profile section of the rung under the action of an adjusting spring and handle and can be locked in this position, and whereby furthermore the locking bolt fixed on the handle is axially movably supported in a guide element mounted on the ladder element.

BACKGROUND OF THE INVENTION

Such a folding ladder is already known from the Offenlegungsschrift DE 44 03 001 A1. The guide element for the locking bolt is in this design constructed on a flange piece, which is riveted or screwed to the respective ladder element.

The purpose of the invention is to design a folding ladder of the type described in detail above in such a manner that such a guide element can be secured in a simple manner on the provided ladder element without having to use an expensive rivet or screw connection. However, such a mounting is at the same time also supposed to offer suitable permanent security against a self-release of the connection.

SUMMARY OF THE INVENTION

The purpose is attained according to the invention in such a manner that the guide element can be fastened on the ladder element by means of a bayonet fitting. A mounting of the guide element designed in this manner can be created with one single manipulation. The elements of the bayonet fitting can be co-provided without any difficulties and additional expense during the manufacture of the guide element and of the ladder element, as will become apparent by the details identified more closely below.

Thus, it is for example advantageous when the bayonet fitting consists of a guide flange provided on the front side on the guide element and a counter flange, which concentrically surrounds in the ladder element a guide hold for the guide element, whereby the guide flange can have at least three holding element, which can be guided through surface-complementary holding recesses of the counter flange, and, after an axial rotation of the guide flange against the counter flange, rests on its front surface not facing the guide element, whereby an annular flange of the guide element, abutting the ladder element, determines the axial introduction of the guide flange into the ladder element.

The counter flange consists thus alone of the receiving recesses, which enlarge the guide hole in the ladder element radially outwardly, and it is thus not a separate structural part, but instead merely a defined surface section of the ladder element. During the introduction of the guide hole into the web of the ladder element, it is automatically and without additional input manufactured at the same time.

The guide flange does not present an obstacle during the movement of the pull-out section on the ladder element, when, as this is common, the web of the pull-out section is guided spaced from the web of the ladder element, which as a rule is already desired for different reasons. Thus, the ends of the rungs project at all times slightly over the web of the pull-out section, to which it is in most cases flanged or connected in a different manner so that this projection requires already a certain spacing between the webs. The ladder elements are therefore equipped with guide edges, which determine the spacing between the respective pull-out sections.

It is advantageous when a position-securing lock is available for the bayonet lock, for example, an eyelet piece with an axis-parallel first pin hole for a locking pin is provided on the circumference of the guide element, which locking pin is driven into a second pin hole in the ladder element, which second pin hole is axially aligned with the first one. The second pin hole is designed such that the locking pin can only be driven in when a secure bayonet fitting has been created, which means, when the guide element, after the introduction of the guide flange into the counter flange, has been rotated accordingly.

In detail, the locking bolt is best constructed pipe-shaped and connected, preferably pinned, to the handle so that it can be changed through a direct manual operation between its axial positions corresponding to locking or unlocking. Furthermore, it is possible to provide a lock against rotation between the guide element and the locking bolt (and thus also the handle).

However, it is particularly advantageous thereby when the lock against rotation is not complete and unreleasable but instead permits a—however, limited—rotation of the locking bolt (and this only in its position when it is removed from the rungs). It can thereby advantageously consist of a crosspin fastened in the guide element and an axis-parallel guide groove in the locking bolt, through which guide groove extends the crosspin. The guide groove has in a preferred embodiment a preferably acute-angled laterally bent section. Such an arrangement offers the advantage that the locking bolt, when it is unlocked, can be moved by a slight rotation into a stable unlocking position so that it need not be held during the adjustment of the respective pull-out section.

An arrangement has been created with the invention, in which the guide element can be mounted quickly and safely on the ladder element, and, moreover, in which care is taken in a simple manner that the unlocking of the locking bolt can be transitioned into a stable position ready for use so that the locking bolt loaded by the adjusting spring on the one hand does not hinder the adjustment of the associated pull-out section and on the other hand does not need to be manually held during such an adjustment. The folding ladder can therefore be manufactured expediently and can be handled comfortably.

BRIEF DESCRIPTION OF THE DRAWINGS

The invention will be discussed in greater detail hereinafter in connection with one exemplary embodiment and the drawings, in which.

DETAILED DESCRIPTION OF THE INVENTION

Figure 1:
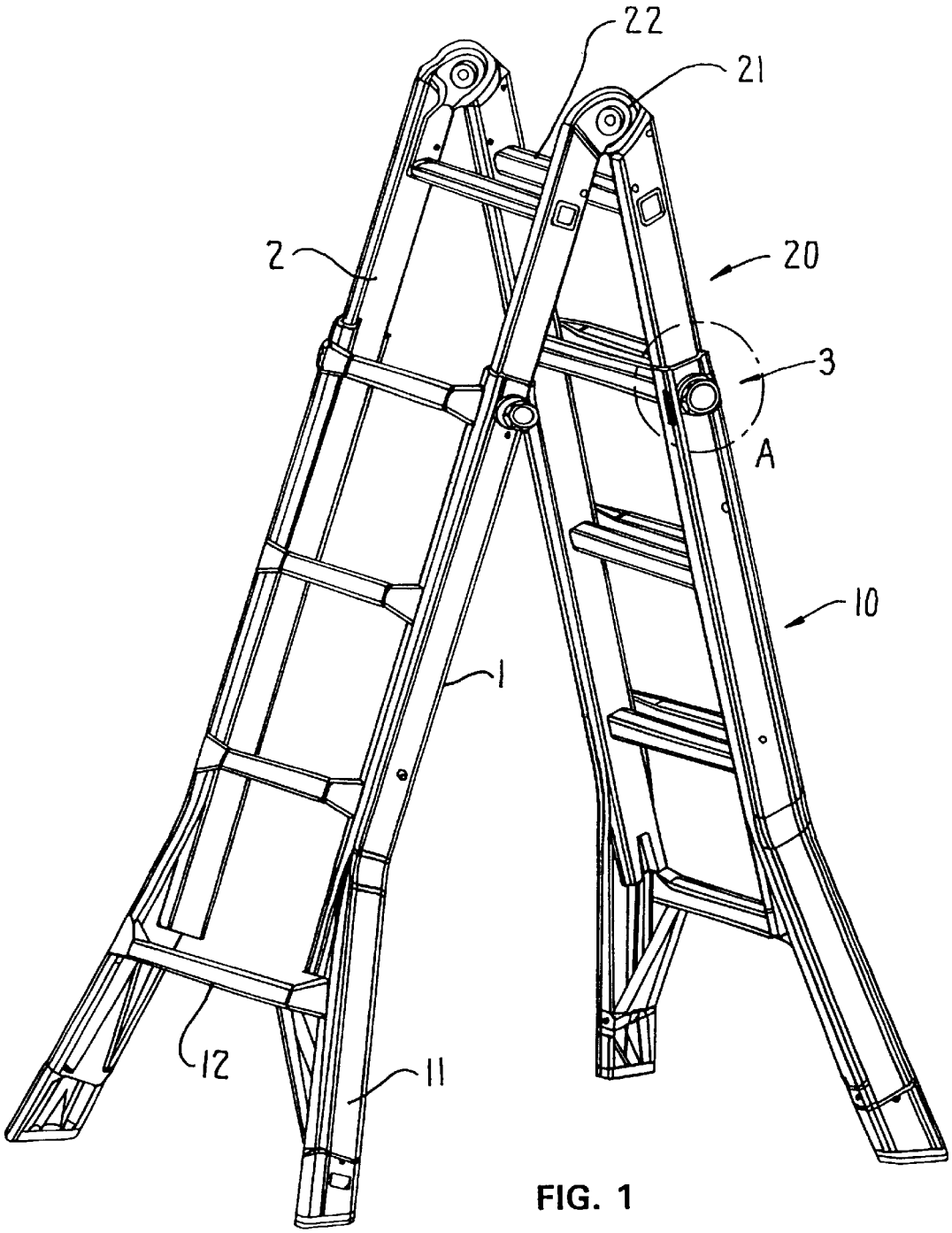
FIG. 1 shows a folding ladder in an isometric view in its position of use.

A folding ladder according to the invention consists in accordance with FIG. 1 first of all of ladder elements 1 with bases 11. Pull-out sections 2 are movable on the ladder elements 1, which pull-out sections 2 are connected with one another in pairs by joints 21 in the exemplary embodiment and form together with the ladder elements 1 a folding ladder. The ladder elements 1 and the pull-out sections 2 permit various operating lengths of the folding ladder due to their reciprocal telescopic movement. The pull-out sections 2 are connected with one another in pairs by rungs 22 to form extension pieces 20; also the ladder elements 1 are assembled in a similar manner in pairs by rungs 22 to form ladder sections 10. The ladder sections 10 and extension pieces 20 of the folding ladder illustrated in the position of use in FIG. 1 are folded together and moved for transport and storage.

Figure 2:
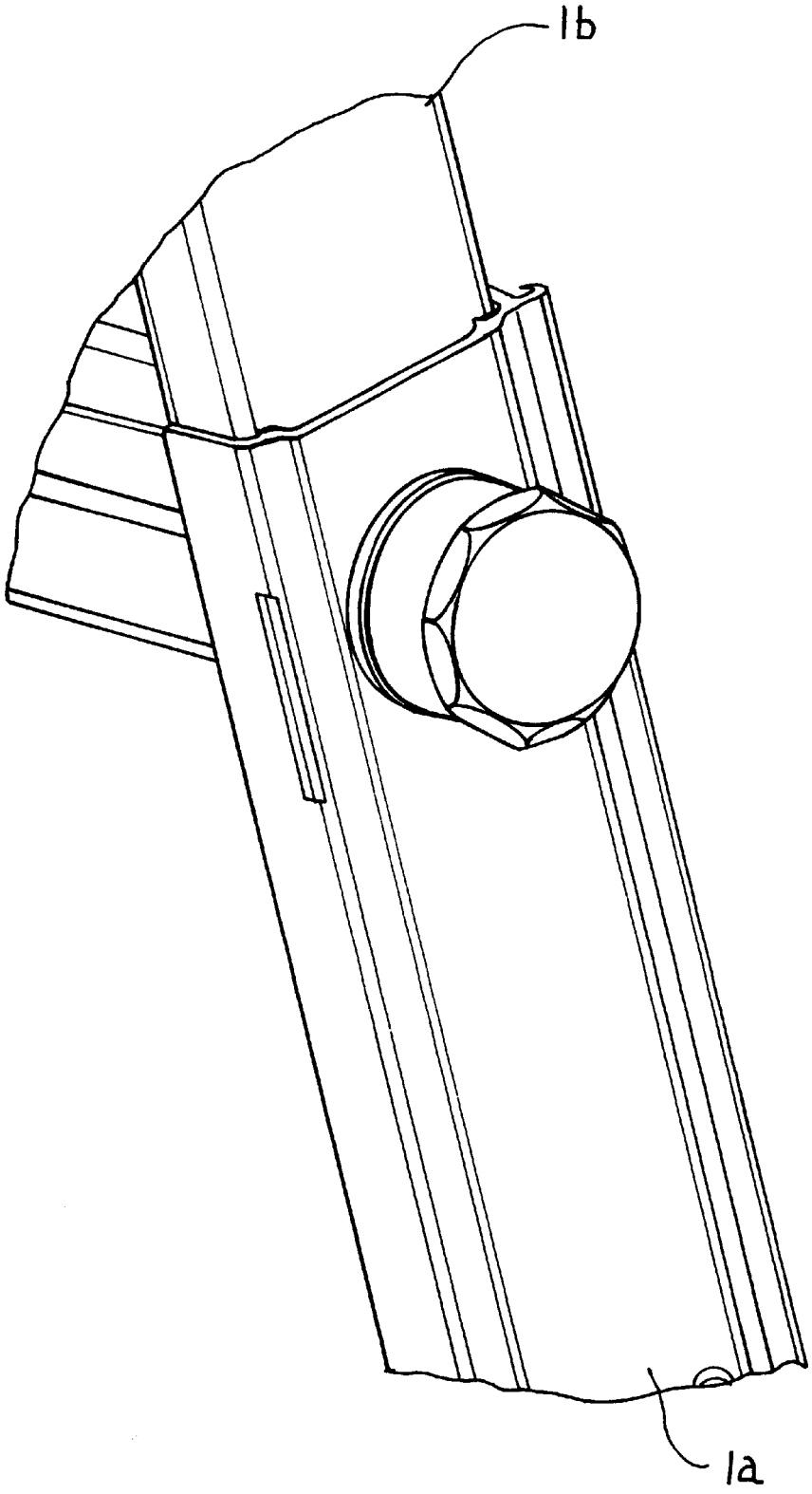
FIG. 2 shows an enlarged detail A of FIG. 1 with a locked pull-out section.
Figure 3:
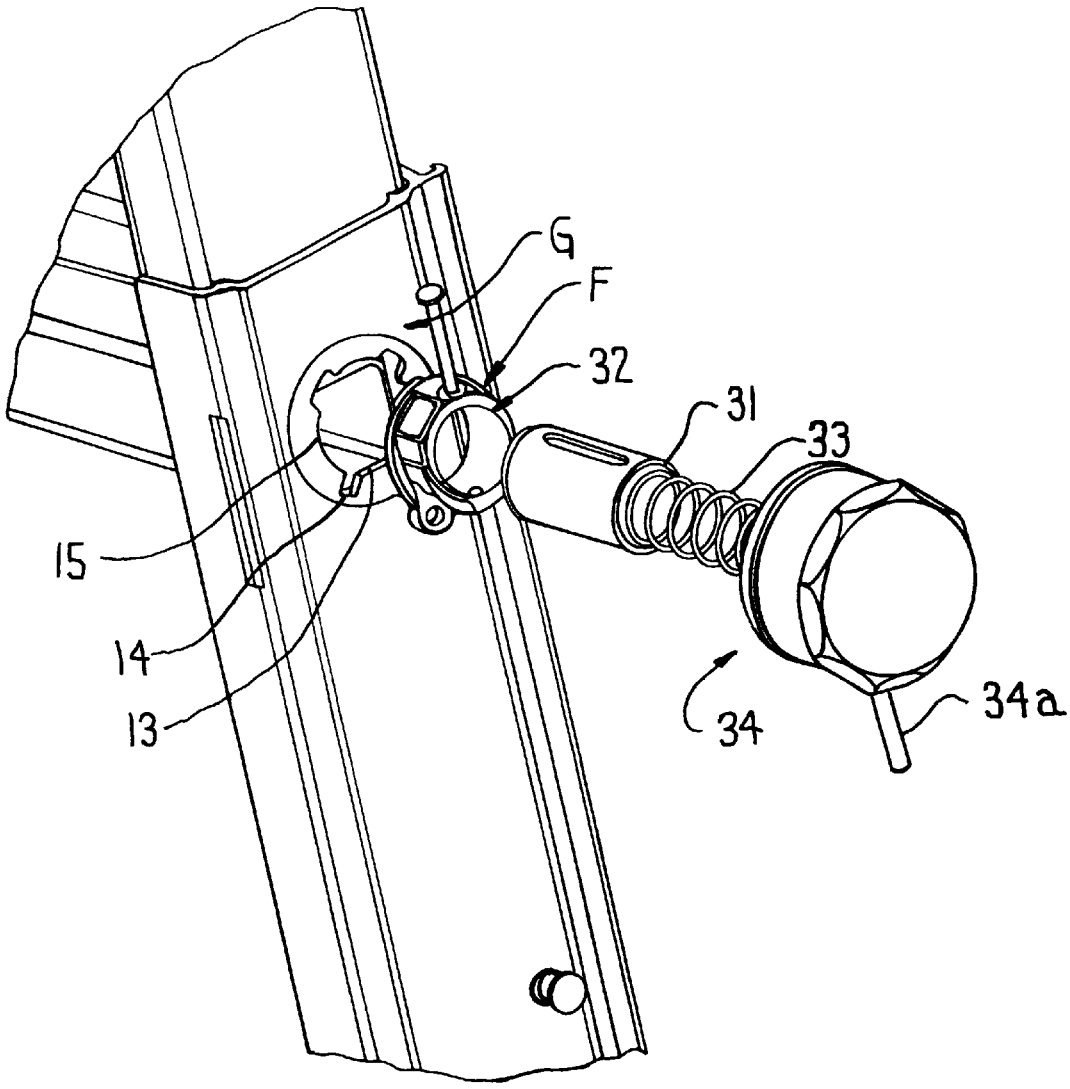
FIG. 3 shows an exploded view of the detail A of the individual parts of the locking mechanism, all in a three-dimensional illustration.

To secure the—extended—position of use of the folding ladder of FIG. 1, a locking mechanism 3 is provided on each pairing of a ladder element 1 and a pull-out section 2, as it can be easily recognized in the enlarged illustration of FIG. 2; the details of such a locking mechanism are shown in FIG. 3.

The pull-out sections 2 are thereby locked on the ladder element 1 by a manually axially movable locking bolt 31, which can be moved into the cross section of a rung 22 designed with a hollow-profile section and can also again be pulled out of this position. Both the locked and also the unlocked position of the locking bolt 31 are designed as stable detained positions as will be shown later on. The details are shown in FIG. 3.

Figure 4A:
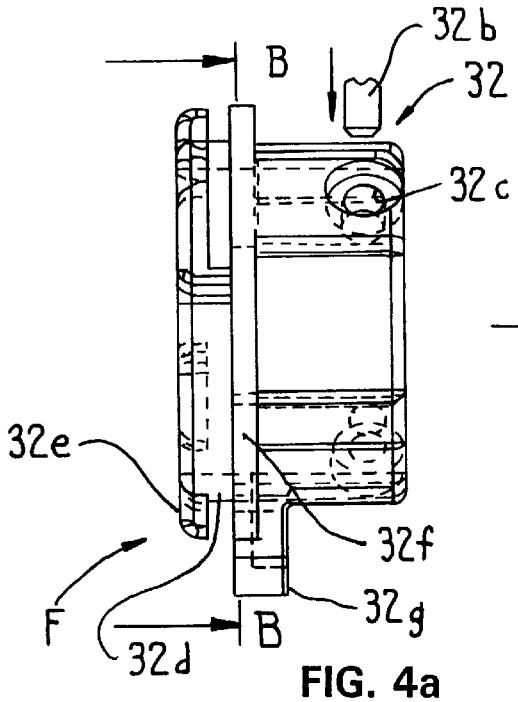
FIG. 4*a* is a side view (FIG. 4*a*) of the guide element of the invention.
Figure 4B:
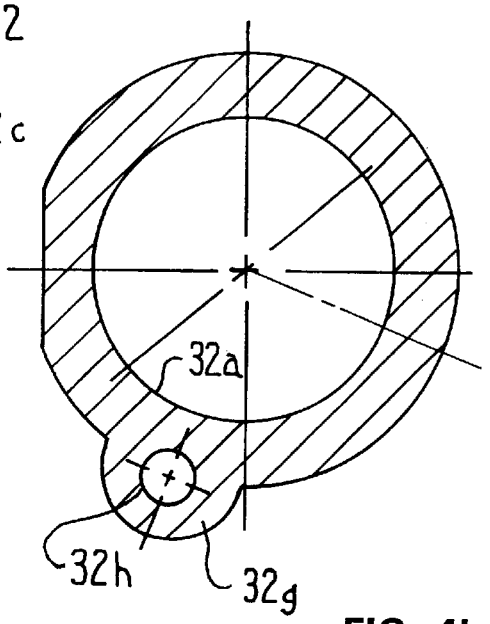
FIG. 4*b* is a cross-sectional view B—B of FIG. 4*a*, and FIGS. 5 and 6 are each a side view of a locking bolt and a handle according to the invention, all in schematically simplified and differently enlarged illustrations.
Figure 5:
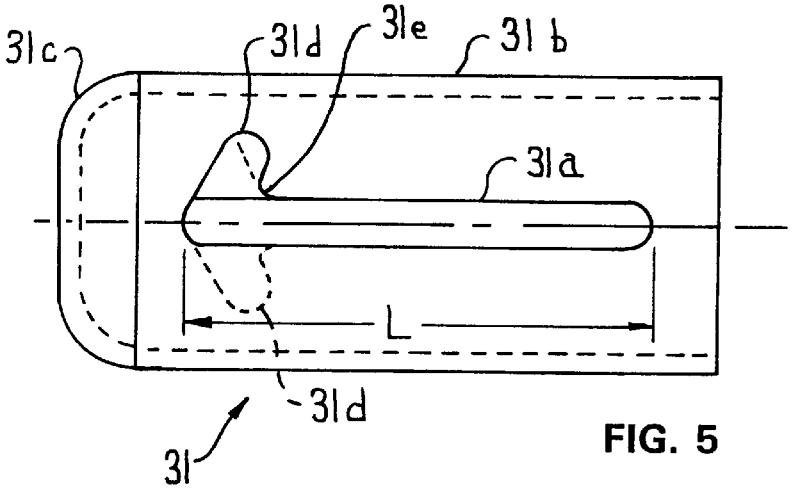

The essentially pipe-shaped locking bolt 31 is axially and—to a limited degree—also rotationally movable in a guide element 32. The guide element 32 has for this purpose (FIG. 4*b*) a bearing hole 32*a*. A crosspin 32*b* extends through axis-parallel guide grooves 31*a* (FIG. 5) in the locking bolt 31, which crosspin, as indicated in FIG. 4*a*, is pinned together with the guide element 32 by means of pin holes 32*c*, after the locking bolt 31 has been introduced into said guide hole. The axial mobility of the locking bolt 31 is thus determined by the length of the guide grooves 31*a*. In the place of one single cross pin 32*b* extending through the entire locking bolt 31 it is also possible to utilize one or two short crosspins 32*b*, which are driven merely into the area of the guide groove 31*a*. The guide groove 31*a* and the crosspin 32*b* thus form a lock against rotation 31*a*; 32*b* of the locking bolt 31.

A front end of the locking bolt 31 is at least partially closed on its end directed into the rungs 22 by a front wall 32*c*, which is flanged, for example, to its hollow-cylindrical body 31*b*; the front wall 32*c* is designed somewhat curved (FIG. 5) so that guiding the locking bolt 31 into the hollow-profile section of a rung 22 is made easier, and serves as an axial fixed bearing for an adjusting spring 33 sunk into the locking bolt 31 (FIG. 3), which adjusting spring loads the locking bolt 31 in the direction of a lock position of the pull-out section 2; this position is thus the position of the locking mechanism 3 which is the regular and stable position without interference.

Figure 6:
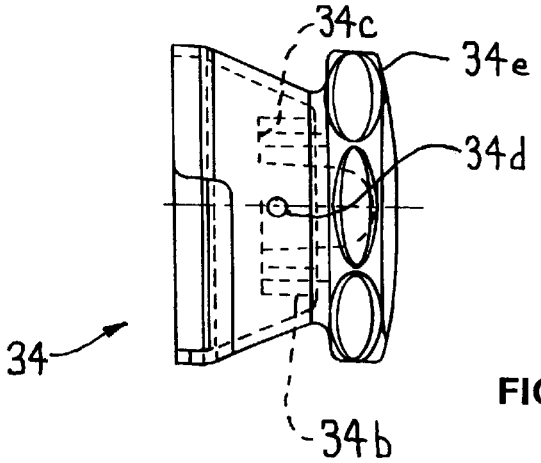

The locking bolt 31 is furthermore fixedly connected to a handle 34, here by means of a connecting pin 34*a* (FIG. 3). The adjusting spring 33 at the other end rests on a further fixed bearing of the handle 34; the handle 34 has for this purpose (FIG. 6) a spring bearing 34*b* for the adjusting spring 33 designed as a cylindrical pressure spring. The spring bearing 34*b* is designed as an axially fixed cylindrical stamped hub, which furthermore has, directed front-sidedly onto the adjusting spring 33, an annular groove 34*c*, into which the locking bolt 31 can be axially received; a cross bore 34*d* (FIG. 6) provided in this area is used to drive in the connecting pin 34*a*. Thus, the locking bolt 31 can be moved with a handle piece 34*e* of the handle 34.

The guide grooves 31*a* are at their end not facing the handle 34 bent at an acute angle each to form a short bent section 31*d*. When the locking bolt 31 is pulled back by means of the handle 34 into its position unlocked from the pull-out section 2, it can be slightly rotated so that the crosspin 32*b* moves into the area of the bent section 31*d*. This unlocked position is stable under the influence of the adjusting spring 33 because the locking bolt 31 cannot "by itself" move back into the axis-parallel area of the guide groove 31*a* but only with the help of the handle 34 after a short movement opposite to the action of the adjusting spring 33, by which the acute wedges 31*e* (FIG. 5) constructed by the bent sections 31*d* can be overcome.

The ladder element 1 (FIGS. 2, 3) is approximately U-shaped in cross section with a web 1*a* between two bent belts 1*b*. FIG. 3 easily shows that a guide hole 13 for the guide element 32, which guide hole 13 is provided in the web 1*a* of the ladder element 1, does not have a closed circular-cylindrical contour. Instead same is radially enlarged on its circumference around essentially rectangular holding recesses 14. Thus,—in the exemplary embodiment, four—holding recesses 14 form (together with the surface sections 15 enclosed by them and edging the guide holes 13) a counter flange G for a guide flange F defining the guide element 32 on its front side, which guide flange (FIG. 4*a*) consists of a flange ring 32*d* and of several (here four) holding elements 32*e* radially following said flange ring. The holding elements 32*e* are approximately surface-congruent with the holding recesses 14 in such a manner that the guide flange F can be placed with its holding elements 32*e* comfortably through the counter flange G with its holding recesses 14. It then rests on the inside of the web 1*a* approximately on the counter flange G and can be rotated such that its holding elements 32*e* move out of the area of the holding recesses 14 and rest on the surface pieces 15. The bayonet fitting F, G formed out of the guide flange F and the counter flange G is locked in this position.

The guide flange F cannot extend at a random distance through the counter flange G because its axial mobility is limited in this direction by an annular flange 32*f* so that the surfaces of the holding elements 32*e* and of the surface sections 15, which surfaces face one another, are closely adjacent. The bayonet fitting F, G can in this manner be realized with relatively little axial clearance, and the guide flange F remains spaced from the pull-out section 2 so that same, when the locking bolt 31 is released from the rungs 22, is freely movable against the ladder element 1.

The guide element 32 is secured in a simple manner against radial rotation. A radial eyelet piece 32*g* is for this purpose constructed on the guide element 32 (FIG. 4*a*), which eyelet piece has a first pin hole 32*h*, which is axis-parallel with respect to the guide element 32. A second pin hole in the web 1*a* (not shown in the drawing) is arranged in such a manner that a locking pin can be driven into these two pin holes when the bayonet fitting F, G is rotated into its locking angular position. Thus, the bayonet fitting F, G cannot be released. In spite of this, it is possible to exchange or remove the guide element 32 without difficulty when needed.

What is claimed is:

1. An extendable ladder including ladder elements, the ladder being telescopically extended by means of pull-out sections movable on said ladder elements, whereby the pull-out sections are fixed by means of a locking mechanism in one of several positions on the respectively associated ladder element on one of its rungs constructed as a hollow-profile section, said locking mechanism including a locking bolt guided into the hollow-profile section of the rung under the action of an adjusting spring and with a handle for locking said locking bolt in one of the positions, and whereby said locking bolt fixed on the handle is axially movably supported in a guide element mounted on the ladder element, wherein the guide element is fastened on the ladder element by a bayonet fitting comprising a guide flange provided on the front side of the guide element and a counter flange that concentrically surrounds, in the ladder element, a guide hole for the guide element, wherein the guide flange includes at least three holding elements guided through surface-complementary holding recesses of the counter flange, and, after an axial rotation of the guide flange against the counter flange, rest on its front surface not facing the guide element, whereby an annular flange of the guide element, abutting the ladder element, fixes the axial introduction of the guide flange into the ladder element.

2. The extendable ladder according to claim 1, wherein a position-securing locking mechanism is provided for the bayonet fitting.

3. The extendable ladder according to claim 2, wherein an eyelet piece with an axis-parallel first pin hole for a locking pin is provided on the circumference of the guide element, and wherein said locking pin is driven into a second pin hole in the ladder element aligned with the first pin hole.

4. The extendable ladder according to claim 1, wherein the locking bolt is pipe-shaped and connected to the handle.

5. The extendable ladder according to claim 1, wherein a lock against rotation is provided between the guide element and the locking bolt.

6. The extendable ladder according to claim 5, wherein the lock against rotation permits a limited rotation of the locking bolt in its position when the locking bolt is pulled off from the rungs.

7. The extendable ladder according to claim 5, wherein the lock against rotation comprises a crosspin fastened in the guide element and extending through a guide groove in the locking bolt, through which guide groove extends the crosspin.

8. An extendable ladder comprising:

ladder elements including rungs, said rungs having a hollow profile section therein;

pull-out sections movable on said ladder elements;

a locking member for insertion into the hollow profile section of one of said rungs;

a handle having said locking member fixedly secured thereto; and a bayonet fitting comprising:

a guide flange, a front surface of said guide flange comprising a guide element secured to said ladder element, said guide element supporting said handle and said locking member for axial movement into the hollow profile section, said guide flange including holding members extending outwardly from the end of said guide element, and a counter flange comprising holding recesses together with interior surface sections of a guide hole in said ladder element, said holding recesses receiving said holding members;

wherein said pull-out sections are secured in one of several positions with respect to a respective one of said ladder elements by said locking member, and wherein axial rotation of said guide flange enables said holding members to be received in the holding recesses of said counter flange to fixably lock said guide element to said ladder element.

9. The extension ladder according to claim 8, wherein a locking pin is provided to prevent rotation of said guide element with respect to said ladder element.

10. The extension ladder of claim 8, including a crosspin fastened in said guide element and extending through a guide groove in said locking member to prevent rotation of said guide element with respect to said locking member.

11. The extension ladder of claim 8, including an adjusting spring biasing said locking member toward the hollow profile section of one of said rungs.

12. The extension ladder of claim 8, wherein said locking member comprises a locking bolt.

13. An extendable ladder including ladder elements, the ladder being telescopically extended by means of pull-out sections movable on said ladder elements, whereby the pull-out sections are fixed by means of a locking mechanism in one of several positions on the respectively associated ladder element on one of its rungs constructed as a hollow-profile section, said locking mechanism including a locking bolt guided into the hollow-profile section of the rung under the action of an adjusting spring and with a handle for locking said locking bolt in one of the positions, and whereby said locking bolt fixed on the handle is axially movably supported in a guide element mounted on the ladder element, wherein a lock against—rotation comprising a crosspin fastened in the guide element and extending through a guide groove in the locking bolt, is provided between the guide element and the locking bolt, the guide groove having an acute-angled bent section, wherein the guide element is fastened on the ladder element by means of a bayonet fitting.

14. An extendable ladder comprising:

ladder elements including rungs, said rungs having a hollow profile section therein;

pull-out sections movable on said ladder elements;

a locking member for insertion into the hollow profile section of one of said rungs, said locking member including a guide groove having a n acute-angled bent section;

a handle having said locking member fixedly secured thereto;

a bayonet fitting comprising:

a guide flange mounted to said ladder element, a front surfacide flange comprising a guide element, said guide element supporting said handle and said locking member for axial movement into the hollow profile section, and a counter flange formed in said ladder element; and a crosspin fastened in said guide element and extending through the guide groove in said locking member to prevent rotation of said guide element with respect to said locking member;

wherein said pull-out sections are secured in one of several positions with respect to a respective one of said ladder elements by said locking member.

* * * * *